United States Patent [19]

Doherty

[11] 3,988,725

[45] Oct. 26, 1976

[54] DETECTOR SYSTEM

[75] Inventor: William F. Doherty, Halifax, Mass.

[73] Assignee: Pyrotector, Incorporated, Hingham, Mass.

[22] Filed: Dec. 12, 1973

[21] Appl. No.: 423,934

[52] U.S. Cl. ..... 340/228 R; 250/339; 250/554; 340/248 A; 340/409

[51] Int. Cl.[2] ..... G08B 17/12

[58] Field of Search ..... 340/228 R, 409, 410, 340/258 R, 248 A; 250/209 X, 209, 554, 339

[56] References Cited

UNITED STATES PATENTS

| | | | |
|---|---|---|---|
| 2,901,740 | 8/1959 | Cutsogeorge | 340/228 R |
| 3,550,120 | 12/1970 | Kompelien | 340/228 R |
| 3,801,972 | 4/1974 | Kim et al. | 340/409 |

*Primary Examiner*—Glen R. Swann, III
*Attorney, Agent, or Firm*—Robert E. Ross

[57] ABSTRACT

A detector system particularly adapted for use in installation where the supply voltage is subject to wide variations comprises a detector which produces a voltage in response to a condition to be detected, a supervisory circuit, and an alarm actuator, in which the voltage signal produced by the detector when the predetermined condition exists, varies in proportion to line voltage, the alarm actuating means produces an alarm when the input signal rises to a predetermined percentage of the line voltage, and the supervisory circuit applies to the signal lead a supervisory voltage which also varies in proportion to the variation of line voltage.

6 Claims, 3 Drawing Figures

DETECTOR SYSTEM

BACKGROUND OF THE INVENTION

Various types of condition sensing devices in common use provide a control unit and a plurality of detector devices connected in parallel across a voltage source. Each detector unit comprises a pair of circuit elements connected in series across the power leads through a junction. At least one of the circuit elements is gradually variable in impedence with a change of condition to be measured or detected, causing a change in voltage at the junction. Means is provided at the control unit responsive to the change in voltage to actuate an alarm, or to control some other device. In one particular type of detector, at least one of said circuit elements is a photo-cell responsive by a decrease in resistance to a particular type of radiation, such as infra-red. A detector system of this type is shown in U.S. Pat. No. 3,122,638 issued Feb. 25, 1964, an improved form of detector element for use therewith is shown in U.S. Pat. No. 3,188,593, issued June 8, 1965, and an amplifier for use with such a system is shown in U.S. Pat. No. 3,725,660, issued Apr. 3, 1973.

One desired feature of such a detector system that has not been heretofore available is satisfactory means for providing an indication of broken or shorted leads to the remote detector elements. In detector devices utilizing photo-cells as described in the above mentioned patents, the cells normally have a very high impedance. Hence it is difficult or impossible to reliably check the continuity of the three leads to a remote detector, since the photo-cells are, in effect, an open circuit during standby conditions.

The object of this invention, therefore, is to provide an economical and reliable circuit for such a detector that is capable of indicating when any one of the three leads to a detector or a group of detectors connected in parallel is broken, shorted to another lead, or shorted to ground, by applying a supervisory voltage to the signal lead in such a manner that the supervisory voltage varies in proportion to variations in the supply voltage, so that the supervisory voltage remains proportional to the voltage produced at the signal lead by a detector in response to an external condition to be detected, and to the voltage to which the alarm actuating unit responds to produce an alarm, so that variations in supply voltage cannot cause a false alarm or a false indication of a broken circuit.

DESCRIPTION OF THE ILLUSTRATED EMBODIMENT

Figure 1:
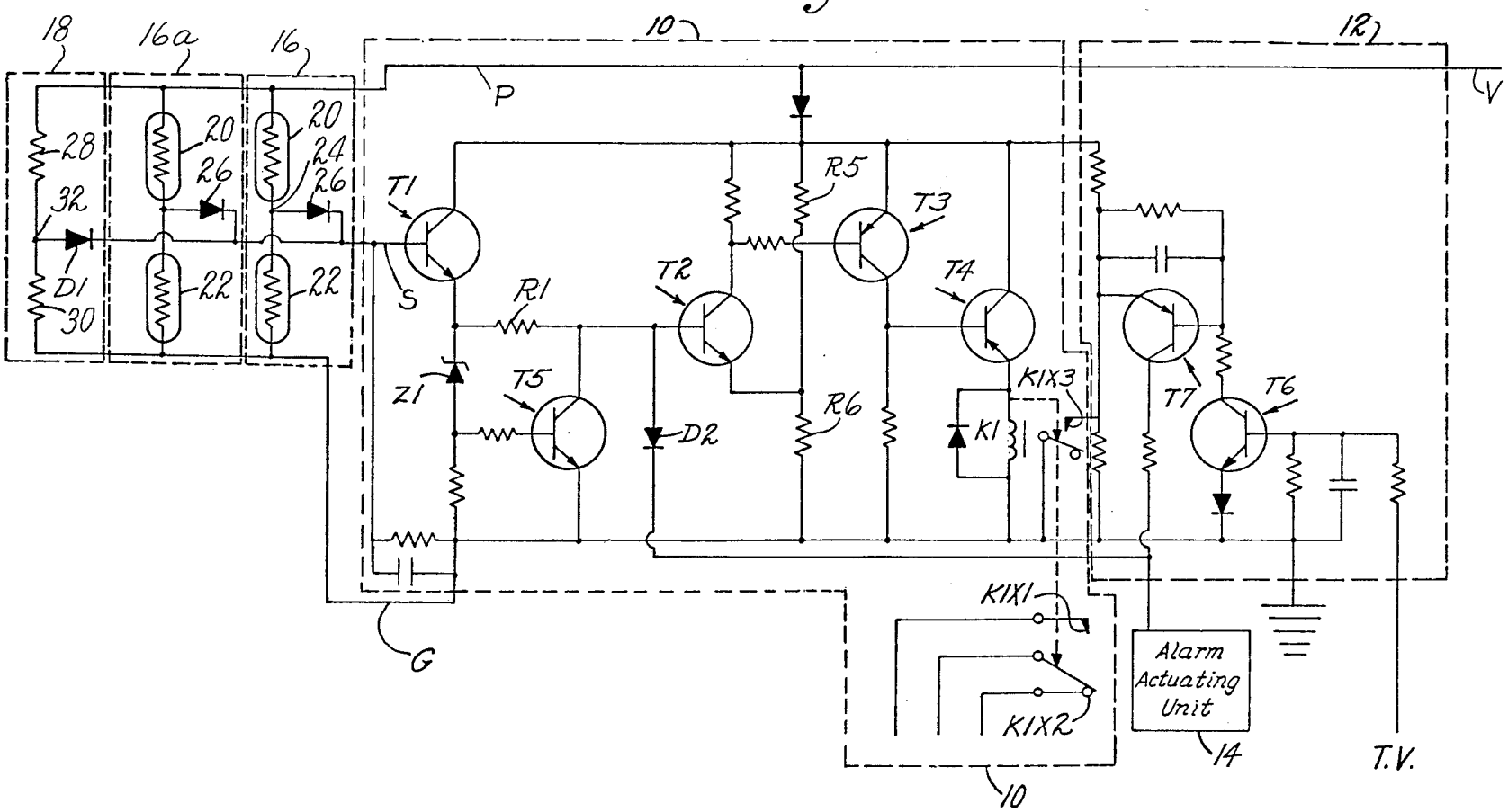
FIG. 1 is a schematic diagram of a detector system embodying the features of the invention.

Referring to the drawing, there is illustrated a schematic diagram of a detector system, comprising a supervisory portion 10, an alarm simulating portion 12, alarm actuating means 14, a group of parallel connected detectors 16, 16*a* which are physically remote from the supervisory portion 10 and connected thereto by leads P, S, and G, and a line terminating element 18 connected to the ends of the leads.

The specific embodiment of the invention illustrated is an optical fire detector in which the detectors 16, 16*a* each comprises a pair of photocells 20 and 22 connected in series between the power source lead P and the ground lead G, with the junction 24 between the photo-cells of each pair being connected through a diode 26 to the signal lead S.

The line terminating element 18 comprises a pair of resistors 28 and 30 connected in series across the leads P and G with the junction 32 between the resistors being connected through a diode D1 to the extreme end of the signal lead S.

The detector units 16 may be photo-cell arrangements as disclosed in the above mentioned U.S. Pat. No. 3,188,593 with the photo-cell 20 being responsive by a drop in resistance to infra-red radiation, and the photo-cell 22 being responsive by a drop in resistance to blue light. Hence infra-red radiation falling on a detector will cause a drop in resistance of the photo-cell 20, increasing the voltage at the junction 24. If the voltage at the junction, and consequently at the input to the supervisory unit exceeds a predetermined value, an alarm is actuated in a manner to appear hereinafter.

To provide means for indicating the existence of a broken lead to the detector units, or a short between leads or to ground (except for a short between the power lead P and ground, which will blow the main fuse) the line terminating unit 18 is provided, connected to the extreme ends of the three leads. The resistors 28 and 30 which are connected across the power source, have values such that a voltage at the junction 32 is established which is about half of the alarm voltage. In a typical installation, the power source may be 28 volts, the alarm voltage 14 volts, and the supervisory voltage 8.5 volts.

Hence during standby conditions, when no appreciable radiation is falling on the photo-cells, they have a very high impedance, for example, 500 megohms in the dark, and several thousand ohms in daylight. Therefore, during such conditions, substantially no current flows through the detectors, however some current flows through the resistors 28 and 30 from the lead P to the lead G.

If any one of the three leads are broken, or shorted to each other or to ground (with the exception of shorting of the power lead P to ground as mentioned above) one of two conditions will result: either the supervisory voltage will be lost or full or nearly full line voltage will appear on the signal lead.

Full or nearly full supply voltage will appear on the signal lead S if the power lead P is shorted to the signal lead, or if the ground wire is broken, since substantially no current flows in the signal lead.

Loss of the 8.5 volt supervisory signal on line S will occur if the power lead P is broken, if the signal lead S is broken, or if the signal lead is shorted to ground.

The supervisory unit 10 is provided with means for passing an alarm signal to the alarm actuating unit, means for providing an indication if the supervisory voltage is lost from the signal lead or if full or substantially full line voltage appears on the signal lead, and means for preventing an alarm signal from being passed to the alarm actuating unit if a voltage a predetermined amount higher than the alarm voltage appears on the signal lead.

The input to the supervisory unit from lead S is to the base of transistor T1, the collector of which is connected to the power lead P and the emitter of which is connected through resistor R1 to the base of transistor T2 and to the alarm actuating unit through diode D2. Transistor T2 is connected in amplifying configuration to transistors T3 and T4. The emitter-collector circuit of transistor T4 is connected in series with a relay K1 across the power source. The relay K1 has normally open contacts K1X1 and normally closed contacts K1X2 for controlling external circuits in any desired manner, and normally open contacts K1X3 for a purpose to appear hereinafter.

The 8.5 volt signal which is applied to the lead S during standby operation maintains transistor T1 in conduction and the current flow in the emitter-collector circuit maintains sufficient voltage at the base of transistor T2 to maintain it in conduction, which also maintains T3 in conduction. So long as T3 conducts, there is also conduction in the emitter-collector circuit of T4 and consequently relay K1 is energized during standby condition.

The alarm actuating unit 14 has means to be described hereinafter for energizing an alarm when the voltage at the input thereto exceeds a predetermined value which, in the illustrated embodiment is approximately 14 volts.

With the 8.5 volt signal existing at the base of transistor T1 and the remaining part of the circuit in the condition described, when radiation from a fire falls on one or more of the detectors, the resistance of cell 20 drops and the voltage at the junction 24, and consequently the voltage at the base of transistor T1, rises. The resulting increase in conductivity through the emitter-collector circuit raises the voltage at the alarm actuating unit.

On failure of the 8.5 volt supervisory voltage for any of the above mentioned reasons, the resulting lack of bias voltage on the base of transistor T2 stops conduction therethrough so that transistor T2 and T3 are also turned off, dropping the bias voltage at transistor T4, which then stops conduction, de-energizing relay K1 and shifting contacts K1X1 and K1X2. The changing of condition of these contacts may be utilized in any convenient manner to give an indication that one or more of the detectors is inoperative.

It will be noted that if the defect in the line causing loss of the 8.5 volt signal occurs at a point electrically beyond one or more of the detectors, it will still be possible for the nearer detector to provide an alarm on the occurrence of a fire within its viewing area, since the increase in voltage thereby applied to the signal lead will bias transistor T1 into conduction so that the alarm voltage will appear at the input to the alarm actuating device.

To provide means for providing an indication of the presence of a short or open circuit that causes line voltage to appear on the signal lead, and to prevent such condition from actuating the alarm, means is provided to short the base of transistor T2 and the input to the alarm actuating device to ground if the voltage at the base of transistor T1 exceeds a predetermined value, for example, 22 volts in the illustrated embodiment. The circuitry for this purpose is more fully described in U.S. Pat. No. 3,268,881 issued Aug. 23, 1966, and in the device of this application includes a Zener diode Z1 connected between the emitter of transistor T1 and the base of transistor T5. The emitter-collector circuit of transistor T5 is connected between the base of transistor T2 and ground. When the voltage at the emitter of transistor T1 exceeds the conduction voltage of the Zener diode, due to excessive voltage on the signal lead S, the voltage that then appears at the base of transistor T5 allows conduction in the emitter-collector circuit, which shorts to ground both the base of transistor T2 and the input to the alarm actuating circuit. Hence a false alarm is prevented, and the loss of base bias on transistor T2 causes the energization of relay K1 to provide a trouble alarm as has been previously described.

In some detector installations it is desired to provide means for checking the operability of the detector system automatically. For this purpose the alarm simulating unit 12 is provided, which comprises a two-stage transistor amplifier with an input transistor T6 from a test voltage source TV and a transistor T7 having a collector-emitter circuit connected between the power source and the alarm actuating unit. The relay contacts K1X3 are connected from the emitter of transistor T7 to ground, with said contacts being open when the relay K1 is energized.

When a test voltage is applied to the input of the alarm simulating unit 12, transistor T6 and T7 conduct to apply an alarm voltage to the alarm actuating device. However, if the signal lead S has lost the supervisory voltage, or if an excessive voltage is present on the supervisory lead, the relay K1 will be de-energized and the contacts K1X3 will be closed. In such case when the test voltage is applied, there will be no output from transistor T7 to the alarm actuating unit since the emitter of said transistor is shorted to ground.

One of the advantages of the detector system disclosed herein is the fact that variations in the supply voltage within any limit to be reasonably anticipated do not affect the alarm point of the detector, nor can the supervisory voltage cause either a false alarm or a false indication of shorted or broken wires with variations in supply voltage.

This feature is provided by the fact that the output voltages of the critical portions of the circuit vary in proportion to line voltage, however the response of the alarm actuating unit is independent of supply voltage in that it produces an alarm signal when the input voltage reaches a predetermined percentage of supply voltage.

Figure 2:
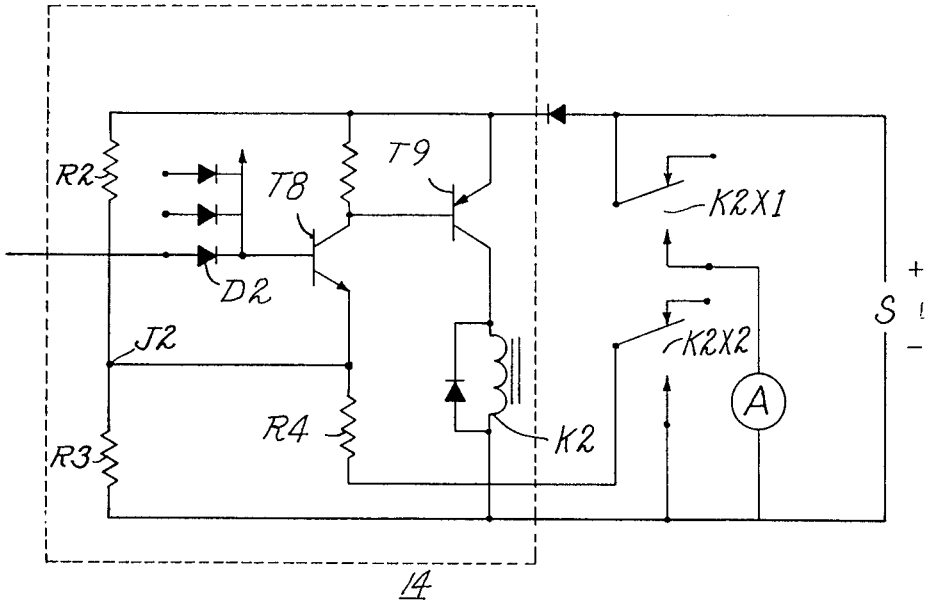
FIG. 2 is a schematic diagram of the alarm actuating unit of a type known in the art which may be used with the system of FIG. 1.

Referring to FIG. 2, it is seen that the output from the supervisory unit is applied to the base of transistor T8, the emitter-collector circuitry which is connected across the power source. Conduction in transistor T8 causes conduction in transistor T9 to energize relay K2 to energize an alarm device. The circuit of FIG. 2 and associated equipment is described in U.S. Pat. No. 3,725,660 issued Apr. 3, 1973. The emitter of transistor T8 is maintained at a predetermined percentage of supply voltage by being connected to the junction of a voltage divider formed across the power source by resistors R2 and R3. The bias applied to the base of transistor T8 by a signal appearing at transistor T1 will cause conduction in transistor T8 only when the signal voltage exceeds the emitter voltage by a predetermined amount.

The voltage appearing at the emitter of transistor T8 will vary in proportion to the line voltage, however since the detectors are supplied from the same voltage source, the voltage produced on the signal lead and consequently the voltage appearing at the base of transistor T8, for a given input of radiation, will also vary with line voltage. Hence when the line voltage is less than normal, both the emitter voltage and the voltage applied to the base resulting from a predetermined amount of infra-red radiation are reduced, so that the alarm point of the system is substantially independent of line voltage.

The supervisory voltage applied to the signal lead also varies in proportion to line voltage since it is produced by a voltage divider across the power source. Hence since the supervisory voltage, the bias necessary to be applied to the base, and the voltage produced by the detectors all vary in proportion to the line voltage, a false alarm or a trouble alarm cannot be caused by variations in supply voltage.

The voltage at which the supervisory unit produces a trouble signal due to loss of the supervisory signal also varies with supply voltage, since the emitter of transistor T2 is maintained at a predetermined percentage of supply voltage by a voltage divider, consisting of resistor R5 and R6 connected in series across the power source. With an increase in supply voltage, the bias required at the base of transistor T2 to maintain it in conduction increases, however the increase in supply voltage also increases the supervisory voltage proportional to the increase in emitter voltage.

Figure 3:
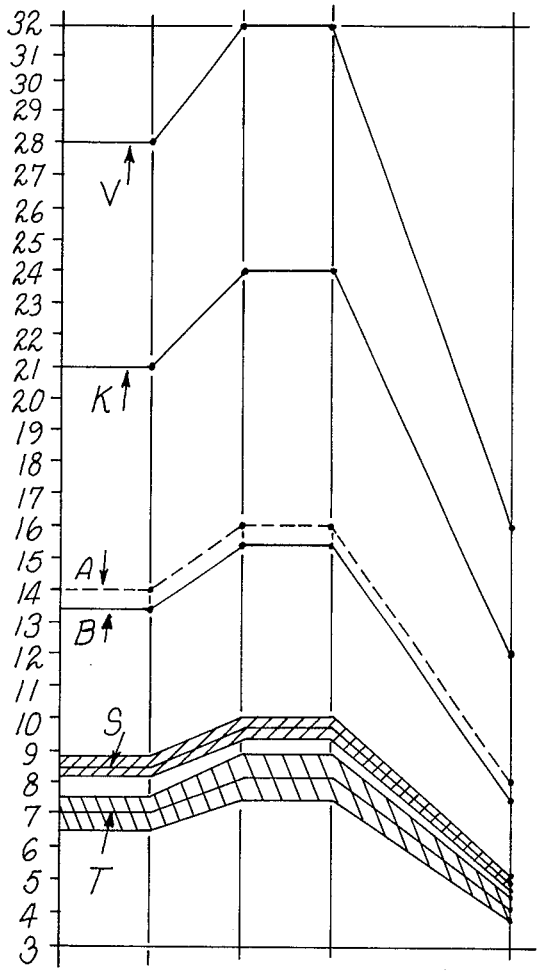
FIG. 3 is a graph showing the variation in voltage at various portions of the circuit with variations in line voltage.

The effect of varying supply voltage on the operation of the system is illustrated in FIG. 3 where V is the supply voltage, B is the bias voltage applied to the emitter of transistor T8, A is the alarm voltage produced at the base of transistor T8 by a detector observing a predetermined amount of radiation, S is the supervisory voltage applied to the signal lead, and T is the voltage on the signal lead below which the relay K1 is de-energized to produce a trouble signal.

In a particular embodiment of the invention, the supply voltage V is nominally 28 volts, the alarm voltage A is 14 volts, the supervisory voltage S is 8.5 volts and the voltage T at which the trouble relay K1 drops out is 7 volts.

Specifications of certain aircraft manufacturers require that the system be capable of operation with a supply voltage that may vary between 32 and 16 volts since such variations may occur in aircraft electrical systems.

The effect of such variation is shown in FIG. 3. As the supply voltage increases the bias voltage B on the emitter of transistor T8 increases, so that a higher voltage is required at the base to actuate the alarm. However, since the higher voltage is also applied to the detector elements, a fire producing a predetermined level of radiation will produce a proportionally higher voltage on the signal lead, as shown by curve A.

In commercial production of systems of the type described herein, the resistors used to provide the supervisory voltage will, of course, vary slightly in value from system to system and it has been found necessary to provide a tolerance in the supervisory voltage of from 8.25 to 8.75 volts, and a tolerance of 6.5 to 7.5 in the minimum supervisory voltage T below which the trouble relay K1 is de-energized.

As shown by the shaded areas, if the supervisory voltage and the minimum voltage on the signal lead at which the relay K1 is de-energized do not vary in proportion to the line voltage, a false indication of trouble could result. Also, unless the supervisory voltage varies in proportion to the supply voltage on extreme low supply voltage conditions, the supervisory voltage could provide a false alarm under conditions of low supply voltage.

Although the illustrated embodiment of the invention is particularly adapted for use as a fire detector in aircraft, it will be understood that the features of the invention may be utilized in other types of detector systems in which the detector elements consist of series connected variable impedence elements.

Since certain obvious changes may be made in the illustrated embodiment of the device without departing from the scope of the invention it is intended that all matter contained herein be interpreted in an illustrative and not a limiting sense.

I claim:

1. A detector system comprising a first resistance means which is variable in response to a condition to be detected in series with a second resistance means across a source voltage, an alarm actuating unit responsive to an increase in voltage at the junction of said first and second resistance means to a predetermined percentage of the source voltage to actuate an alarm, and means applying a supervisory voltage to the junction which is proportional to the source voltage and less than the voltage required to actuate the alarm, and means responsive to the dropping of the supervisory voltage to a predetermined lesser percentage of the source voltage to actuate means for indicating said drop in voltage.

2. In an optical detector system comprising a detector cell in series with a resistor, a power source providing a first voltage across the cell and resistor, whereby a drop in resistance of the cell causes an increase in voltage at the junction, of said cell and resistor means responsive to the increase in voltage at said junction to a predetermined percentage of said first voltage to actuate an alarm, the improvement comprising means providing a second voltage from the power source at said junction which is porportional to said first voltage and less than said predetermined percentage of said first voltage, and means providing an indication of failure of said second voltage when said second voltage drops to a predetermined lesser percentage of said supply voltage.

3. A detector system as set out in claim 2 in which said means providing a second voltage at said junction comprises a pair of resistors connected in series across said power source, said resistors having values such that a voltage is established at their junction which is a lesser percentage of the first voltage than the predetermined percentage of the first voltage at which the alarm is actuated, said junction of said pair of resistors being connected to the junction of the cell with the resistor in series therewith.

4. A condition sensing system, comprising a pair of power leads providing a supply voltage, a plurality of condition sensing devices, each device comprising a pair of impedance elements connected in series across said power leads, at least one of said impedance elements being responsive by a change in impedance to a condition to be measured or detected whereby the voltage at the junction of said impedance elements changes, the junctions of said plurality of sensing devices being connected by similarly poled diodes to a common signal lead, voltage ratio sensing means connected to one end of the signal lead and means connected to the other end of the signal lead for continuously applying to said signal lead a supervisory voltage from the power leads which varies in proportion to the supply voltage, said voltage ratio sensing means being responsive to the dropping of the supervisory voltage to a predetermined lesser percentage of the supply voltage to give an indication of loss of supervisory voltage, and responsive to the existance of an alarm voltage on the signal lead which is an appreciably higher percentage of the supply voltage to actuate an alarm, and responsive to a voltage on the signal lead which is an appreciably higher percentage of the supply voltage than said alarm voltage to prevent the actuation of said alarm.

5. A detector system as set out in claim 4 in which the means connected to the other end of the signal lead for applying a supervisory voltage thereto comprises a pair of resistors connected in series across the power leads with the junction between the resistors being connected to the signal lead through a diode poled in the same direction as the diodes connected to the condition sensing devices.

6. A detector system, comprising a detector unit comprising a first pair of resistors connected in series across a voltage source, at least one of said resistors being variable in resistance in response to an external condition to be measured or detected, whereby a voltage change occurs at the junction of said resistors, the voltage at said junction under a predetermined external condition varying in proportion to variations in the source voltage, means responsive to an increase in said junction voltage to a first predetermined percentage of the source voltage to actuate indicating means, a second pair of resistors connected in series across the voltage source, the junction of said second pair of resistors being connected to the junction of said first pair of resistors, said second pair of resistors having values such that the voltage at their junction is a second predetermined percentage of the source voltage which is less than said first percentage, and means indicating the decrease in the junction voltage to a third percentage of the source voltage which is appreciably less than the second percentage.

* * * * *